United States Patent [19]

Cook et al.

[11] Patent Number: 4,601,672

[45] Date of Patent: Jul. 22, 1986

[54] ACTION FIGURE IN WHICH MANIPULATION OF ONE ARM PRODUCES ROTATION OF BOTH LEGS ABOUT A VERTICAL AXIS

[75] Inventors: Stuart A. Cook, New Richmond, Ohio; John F. Mayer, Fort Thomas; David W. Tucker, Florence, both of Ky.; William N. Smith, Batavia, Ohio

[73] Assignee: CPG Products Corp., Minneapolis, Minn.

[21] Appl. No.: 699,622

[22] Filed: Feb. 8, 1985

[51] Int. Cl.[4] ..... A63H 3/20

[52] U.S. Cl. ..... 446/330

[58] Field of Search ..... 446/330, 334, 320, 390, 446/376, 352, 378, 383, 384, 333, 338, 336, 340, 359, 365, 317, 268

[56] References Cited

U.S. PATENT DOCUMENTS 3,648,405 3/1972 Tepper ..... 446/330

4,052,813 10/1977 Crain et al. ..... 446/352

4,226,045 10/1980 Lehmann et al. ..... 446/320 X 4,339,889 7/1982 Guerrero et al. ..... 446/390 X

*Primary Examiner*—Mickey Yu

*Attorney, Agent, or Firm*—Gene O. Enockson; L. MeRoy Lillehaugen; Stuart R. Peterson

[57] ABSTRACT

The toy action figures includes upper and lower hollow torso portions. An actuating mechanism is contained in the upper torso and acts through a helical gear mechanism to rotate the lower torso portion and the legs attached thereto about a longitudinal axis when one of the figure's arms is swung from a diverging relation toward one side of the figure. A spring is used to return the actuating mechanism and the limbs associated therewith back to their normal or unactuated positions. Another spring releases or disconnects the lower torso portion from the actuating mechanism should the child attempt to twist the two torso portions relative to each other by using too much force.

19 Claims, 14 Drawing Figures

ACTION FIGURE IN WHICH MANIPULATION OF ONE ARM PRODUCES ROTATION OF BOTH LEGS ABOUT A VERTICAL AXIS

BACKGROUND OF THE INVENTION

This invention relates generally to toy figures having movable limbs, and pertains more particularly to an action figure in which a 360° rotation of both of the figure's legs is derived from a manipulation of one arm in a lateral direction toward one side of the figure.

SUMMARY OF THE INVENTION

An object of the present invention is to provide an action figure in which the child can swing one of the figure's arms from an extended angular position toward one side of the figure, thereby producing a rotation of the lower torso portion and the legs attached thereto about a vertical axis through 360°, that is, one complete circle or revolution. Thus, an aim of the invention is to effect a novel leg rotation by merely swinging one of the figure's arms in a particular direction so as to cause an actuating mechanism to transmit and convert the angular arm movement to the desired rotation of the legs. It is also within the purview of the invention to have both the arm that is actuated and the legs returned to their normal or unactuated positions through the agency of a spring contained in the upper torso portion of the action figure.

Another object of the invention is to provide an action figure of the foregoing character that can be readily manipulated by children of various ages. Inasmuch as it is contemplated that relatively small children will play with an action figure of this type, it is intended that the figure be ruggedly constructed and not likely to break even when roughly handled by rather small children. In this regard, a specific feature of the invention is to utilize a spring-type release should the child try to twist the legs and the lower torso portion on which the legs are mounted relative to the upper torso portion in which the acutating mechanism is contained, thereby avoiding damage to the parts comprising the actuating mechanism.

The invention also has for an object the providing of an action figure that can be made on a relatively small scale, and which will also be quite inexpensive to manufacture.

Another object is to provide an action figure in which the limb movement simulates that of a well-known comic character.

Still further, the invention has for an object the provision of an actuating mechanism for transmitting the arm movement to the legs is entirely concealed within the upper torso portion of the figure. Additionally, a realistic appearance is imparted to the figure without any detraction due to employing any non-human external member (or members) for producing the leg rotation. Stated somewhat differently, the use of an arm avoids the need for a special lever or similar member on the outside of the figure that would render the figure less natural looking.

Briefly, our invention envisages the mounting of one arm in a manner such that it can be swung downwardly in a vertical plane from an elevated position toward one side of the figure to a second position much closer to the figure. This is achieved by having a ball and socket type of joint, the ball being at the upper end of the actuating arm and the socket being formed in the upper torso portion. The socket has a vertical slot through which extends a cam lever that is integral with the ball. The cam lever also has a slot, one that receives therein an outwardly directed pin on a ring follower that encircles a helical gear formed on the upper portion of a shaft that extends downwardly into fixed engagement with the lower torso portion. The figure's legs are attached to lower torso portion so that when the shaft rotates the lower torso relative to the upper torso, the legs, being attached to lower torso portion, also rotate. The ring follower includes a pair of ears that straddle a spiral flight on the helical gear, the flight making a complete circle so that when the arm is swung from an upper or outwardly angled position to a lower position near the side of the figure, then the ring follower causes a complete revolution of the helical gear and complete revolution of the shaft portion that is releasably connected to the lower torso on which the legs are mounted. A specially configured spring provides the releasable connection so as to prevent damage to the actuating mechanism should the child attempt with too much force to twist manually the lower torso portion relative to the upper torso portion. In this way, the legs are rotated about a vertical axis. Another spring acts in a manner to raise once again the actuating arm when this arm is not being manipulated by the child; the mechanism at the same time returns the legs to their initial or unrotated position.

DESCRIPTION OF THE PREFERRED EMBODIMENT

Figure 1:
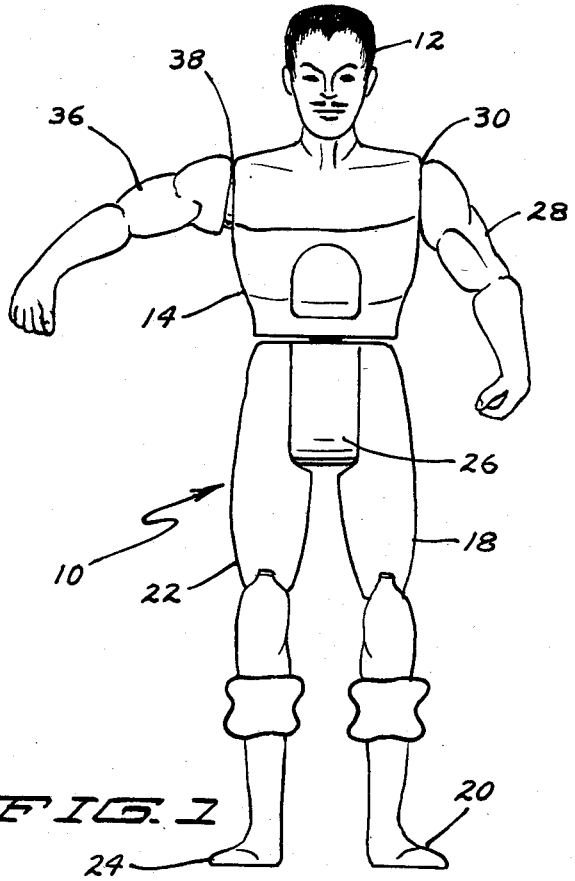
FIG. 1 is a front elevational view of a toy figure illustrating our invention, the right arm and both legs being unactuated so that the feet point forwardly.

Referring now in detail to the drawings, the toy action figure illustrating our invention has been denoted generally by the reference numeral 10. The FIG. 10 includes a head 12 mounted on a hollow upper torso portion 14 comprised of front and rear shells, the upper torso portion 14 having a bottom panel labeled 16.

Figure 10:
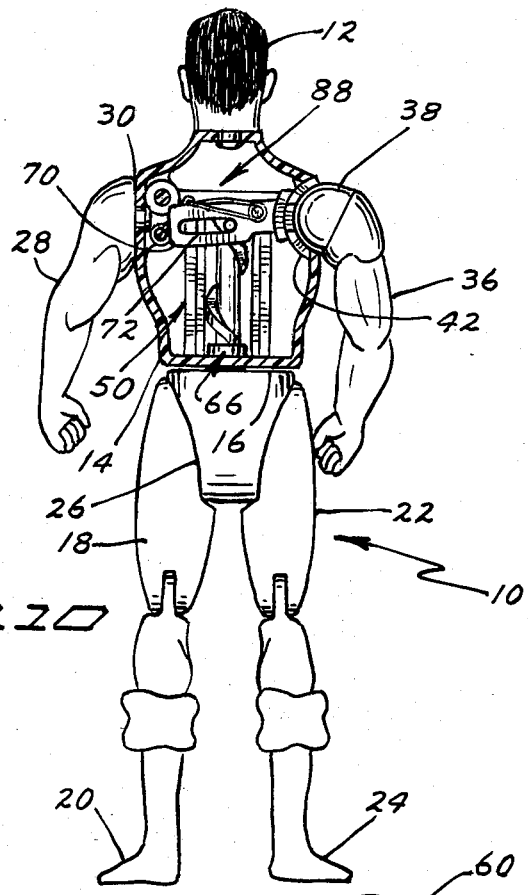
FIG. 10 is a view corresponding to FIG. 5, the right arm in this instance being relatively close to the right side of the figure and the legs having been rotated through a complete circle.

The action FIG. 10 additionally includes a left leg 18, a left foot 20, a right leg 22, and a right foot 24. The legs 18 and 22 are mounted on a lower torso portion 26 disposed subjacent the bottom panel 16. The mounting of the legs 18 and 22 to the lower torso portion 26 is not important as far as the present invention is concerned; however, as will be described hereinafter, the mounting of the lower torso portion 26 so as to rotate relative to the upper torso portion 14 is of importance.

Continuing with the detailed description of the action FIG. 10, a left arm 28 has a shoulder 30. A hole 32 in the upper torso portion 14 enables a pivot pin 34 to extend therethrough so that the left arm 28 can be swung, if desired, about a horizontal axis provided by the pivot pin 34. The mounting of the left arm 28, it can be pointed out, is not part of our invention.

At this time, attention is directed to a right arm 36 having a shoulder 38. The shoulder 38 includes a semi-spherical socket 40 having a vertical slot 42 therein. The socket 40 receives a semi-spherical ball 44 having a flat shank 46 extending inwardly through the vertical slot 42. By means of curved wings or flanges 48, the ball 44 is mounted to the upper torso portion 14 so that the arm 36 can be swung from an outwardly angled position, such as that depicted in FIGS. 1 and 6, to a position much closer to the right side of the action FIG. 10, such as that illustrated in FIGS. 5 and 10. If desired, the right arm 36 can be attached to the ball 44 by means of a pin much like the pivot pin 34 used in mounting the left arm 28. Such a mounting merely gives the child the opportunity to pose the arm 36 in various positions prior to manipulating the arm 36 in a manner yet to be described.

Figure 14:
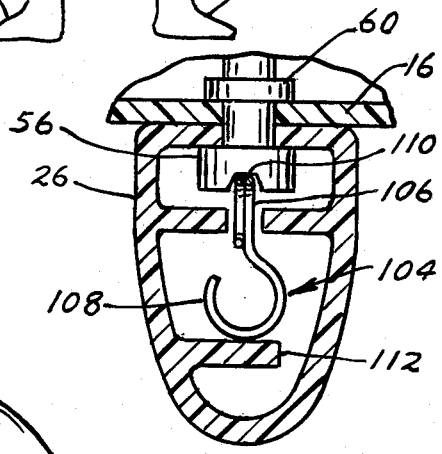
FIG. 14 is a sectional detail taken in the direction of line 14—14 of FIG. 12 for the purpose of more clearly illustrating how the lower torso is releasably coupled to the actuating mechanism that converts the angular arm movement to the desired rotation of the legs.
Figure 11:
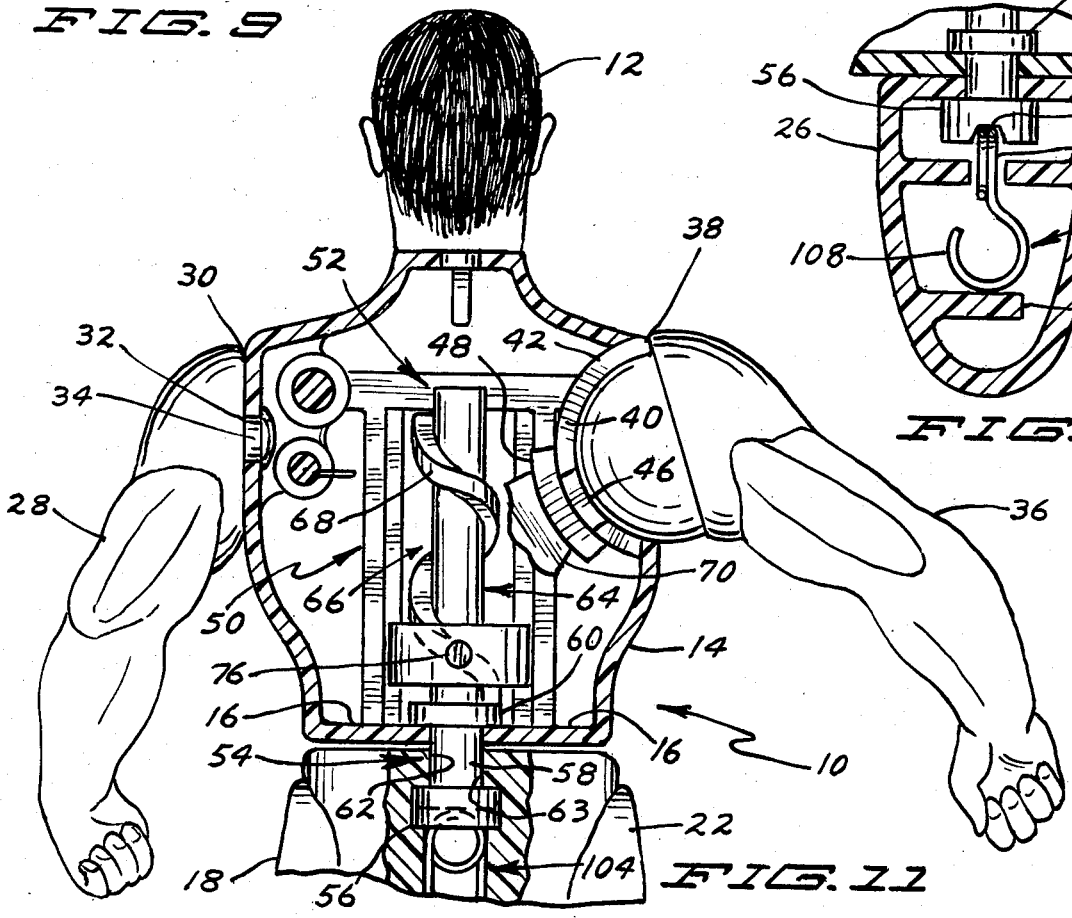
FIG. 11 is an enlarged view similar to FIG. 6 but with a cam lever that is integral with the arm ball having been broken away so as to expose to better view parts that would otherwise be concealed.
Figure 12:
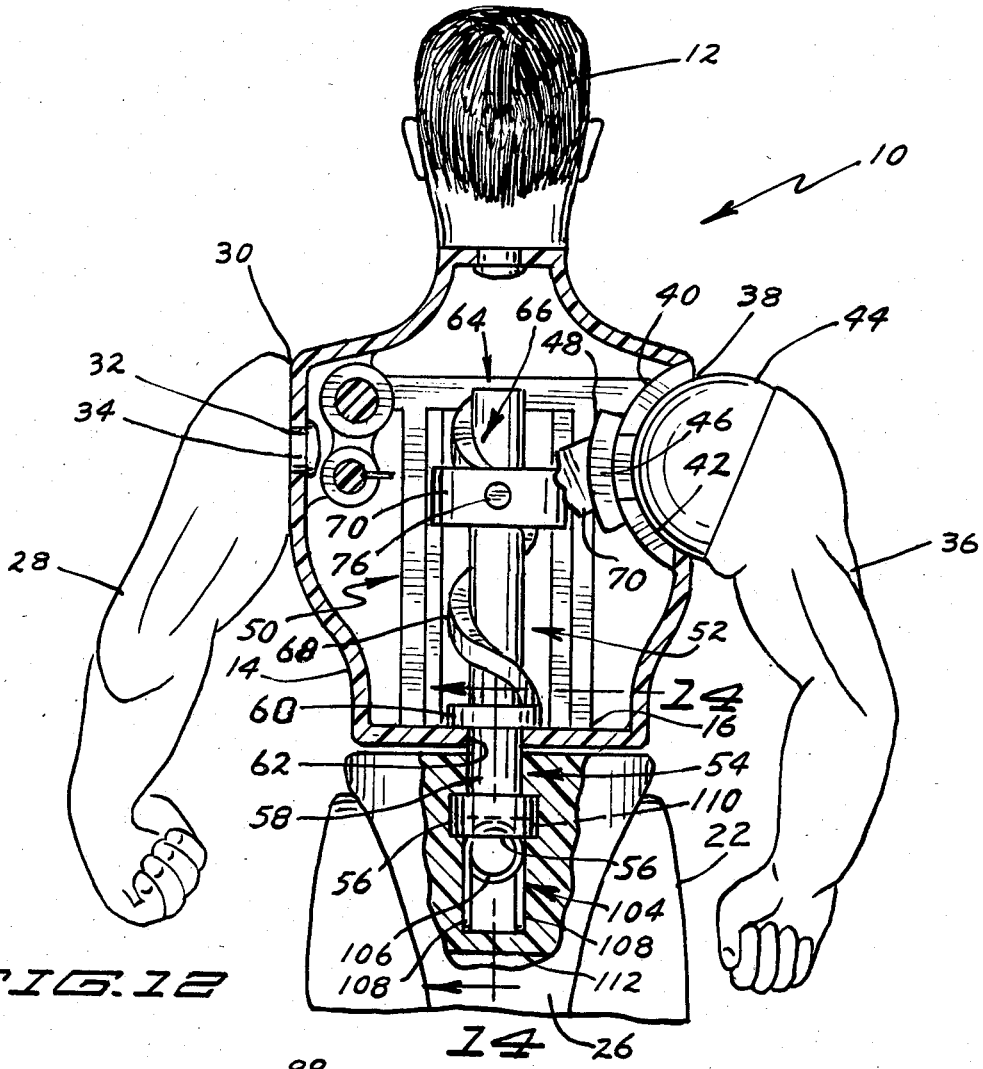
FIG. 12 is a view corresponding to FIG. 11 but depicting the right arm in a fully actuated position.

Attention is directed at this stage to an actuating mechanism indicated generally by the reference numeral 50. The mechanism 50 includes a vertical shaft 52 having a lower portion 54. The lower portion 54 is comprised of a bottom flange 56, a sleeve 58, and a collar 60. The sleeve 58 is journaled for rotation about a vertical axis by reason of a circular aperture 62 provided in the bottom panel 16 of the torso 14. The flange and a portion of the sleeve 58 are received in a complementally configured socket 63 formed in the lower torso portion 26, as can be seen in FIGS. 11, 12 and 14. The collar 60 overlies the marginal portion of the bottom panel 16 that is circumjacent the aperture 62. The lower portion 54, more specifically its flange 56 is releasably coupled to the lower torso portion 26 in a manner soon to be described.

The vertical shaft 52 also includes an upper portion 64 that constitutes a helical gear 66 having a spiral flight 68 thereon. The spiral flight 68 extends through a complete circle, that is, a full 360°; of course, the flight 68 could extend through more than 360°.

Continuing with the description of the actuating mechanism 50, it will be seen that there is a cam lever 70 having a slot 72 formed therein. The lever 70 is integral with the ball 44 belonging to the right arm 36. Thus, when the arm 36 is swung toward the right side of the action FIG. 10, the lever 70, being integral therewith, moves through a corresponding angle.

Figure 13:
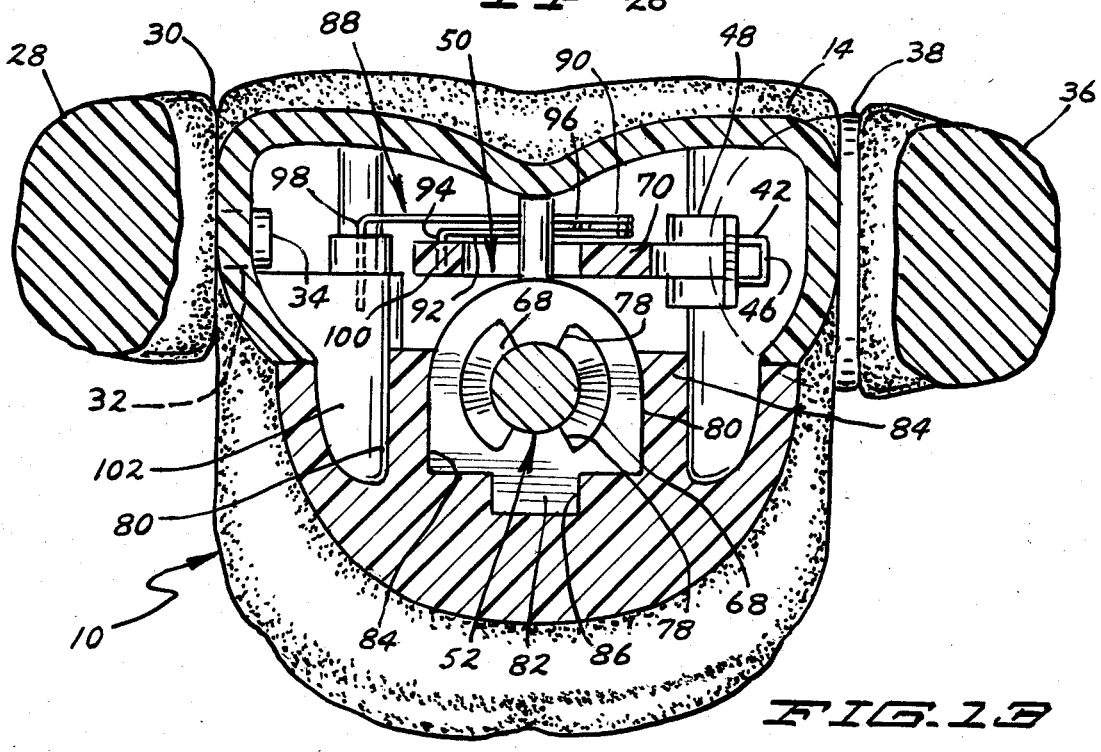
FIG. 13 is a considerably enlarged sectional view looking up in the direction of line 13–13 of FIG. 6.

At this time, reference is made to what will be termed a follower ring 74. The ring 74 has a pin or a lug 76 that projects outwardly, more specifically, rearwardly through the slot 72 in the lever 70. As best viewed in FIG. 13, there are two pins or lugs 78 that extend toward each other so as to engage the flight 68 of the helical gear 66. The so-called follower ring 74 is formed with parallel side edges labeled 80 and a rearwardly directed tongue 82. By means of laterally spaced ribs 84, the follower ring 74 is constrained to traverse a rectilinear path when actuated by the cam lever 70. Also assisting in constraining the follower ring 74 for rectilinear movement is a vertical groove 86 which slidably receives therein the tongue 82.

A hairpin spring 88 has wire coils or convolutions 90, a first wire leg 92 formed with an end portion 94 extending at right angles to the leg, and a second wire leg 96 having an end portion 98 extending at right angles thereto. The purpose of the spring 88 is to return the actuating mechanism 50 to its initial or unactuated state, and, of course, the limbs 18, 22 and 36 to their initial or unactuated positions. To accomplish this, an ear 100 is provided on the cam lever 70 with which the end portion 94 is engaged. The end portion 98 on the leg 96, however, is reactively engaged with a molded portion 102 that is integral with the torso 14.

A feature now to be described performs an overload function, avoiding unwanted damage to the actuating mechanism 50 and the parts associated therewith. In this regard, it is recognized that the child might attempt to forcibly twist the legs 18, 20 and the lower torso portion 26 relative to each other. Therefore, the lower torso portion 26 is resiliently and releasably connected or coupled to the lower shaft portion 54 in order to minimize the likelihood of breakage should the child twist with too much force the lower torso portion 26 wiht respect to the upper portion 14.

Accordingly, a specially configured spring 104 is employed, having one (or two) central coil or convolution 106 and circular end portions 108, the circular end portions 108 residing in laterally spaced vertical planes as clearly evident in FIGS. 11 and 12 so that they confront the sidewalls of the lower torso portion. The uppermost segment of the central coil or convolution 106 extends into a downwardly facing groove 110 formed diametrically across the bottom surface of the flange 60, whereas the lowermost segments of the circular end portions 108 rest on a horizontal shelf 112 integral with the backside of the lower torso portion 26, as easily understood from FIG. 14. The groove 110 has downwardly diverging sidewalls as can also be seen from FIG. 14 so that the coil 110 can be flexed downwardly to uncouple the actuating mechanism 50 from the lower torso portion 26.

Insofar as the operation of our toy action figure 10 is concerned, the child only has to manipulate the right arm 36. In its unactuated position, the arm 36 extends angularly downwardly and away from the right side of the FIG. 10. When in this position, the lower torso portion 26, being releasably attached to the lower portion 54 of the vertical shaft 52, is in a non-rotated position such that the feet 20 and 24 point forwardly. This condition is portrayed in FIGS. 1 and 6. From FIG. 6, it will be perceived that the cam lever 70 is angled downwardly and that the follower ring 74 is at the bottom of its travel, the bottom location of the follower ring 74 also appearing in FIG. 11.

However, when the child presses the right arm 36 toward the right side of the action FIG. 10, that is, in the direction of the upper torso portion 14, then the lower torso portion 26 is rotated. Once again it must be kept in mind that the lower torso portion 26 is resiliently coupled to the vertical shaft 52, more specifically to the lower portion 54 thereof. Hence, when the right arm 36 is moved from the position depicted in FIG. 1 to that shown in FIG. 2,, then the lower torso portion 26 is rotated through an angle of 90°. Stated somewhat differently, the feet 20 and 24 are turned to the left, as clearly pictured in FIGS. 2 and 7. From FIG. 7, though, it can be appreciated that the cam lever 70 has been swung upwardly somewhat, thereby camming the pin or lug 76 on the follower ring 74 upwardly. This, quite obviously, causes the follower ring 74 to move from the lowermost position in which it appears in FIG. 6 to the somewhat more elevated position in which it appears in FIG. 7. As the follower ring 74 moves upwardly, being constrained to traverse a rectilinear path, the two pins or lugs 78, which straddle the spiral flight 68, act against the flight 68 so as to produce a partial rotation of the shaft 52.

Figure 3:
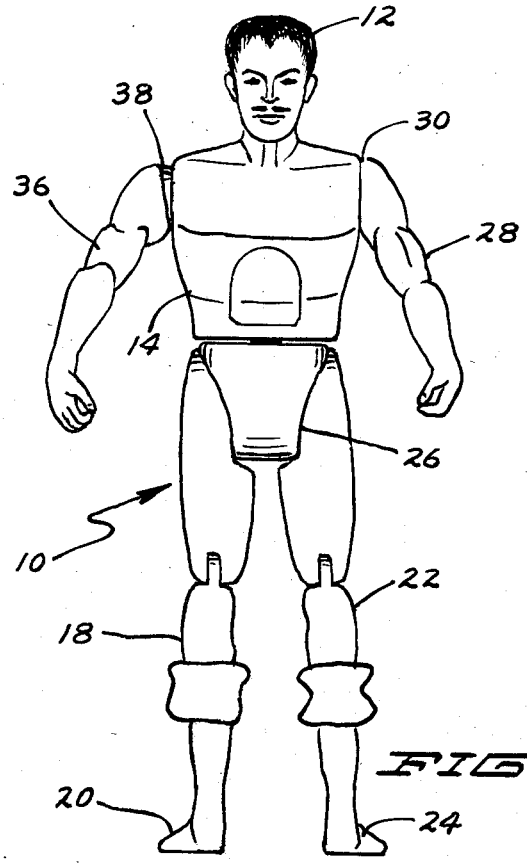
FIG. 3 is a view depicting the arm in a somewhat more advanced position which position is closer to the right side of the body and with the legs rotated through 180°.
Figure 8:
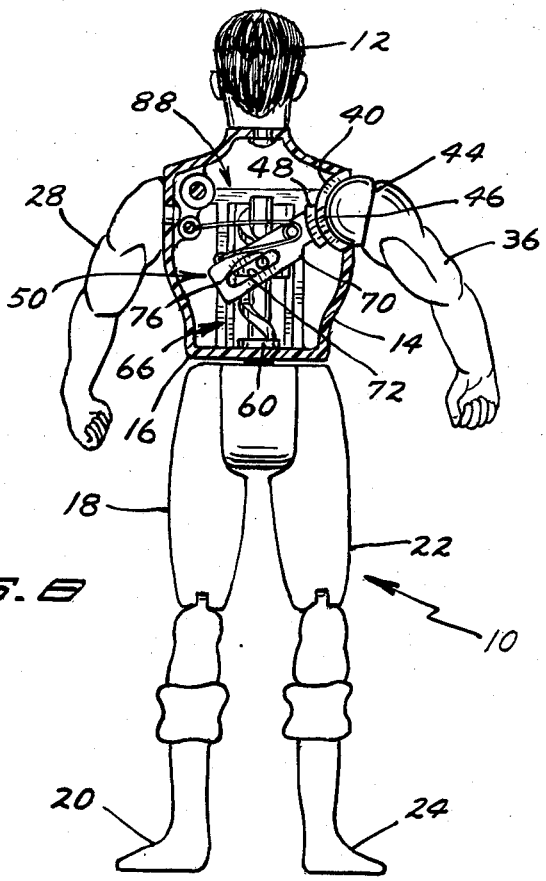
FIG. 8 is still another view, this view being a view from the rear but corresponding to the extent of actuation set forth in FIG. 3.

Continued manipulation of the right arm 36 toward the right side of the FIG. 10 produces a further rotation of the lower torso portion 26 so that the legs 18 and 22 rotate an additional 90° which causes the feet 20 and 24 to face rearwardly. The rearward facing of the feet 20 and 24 appears in FIGS. 3 and 8. It will be observed that the angle of the cam lever 70, owing to the fact that it is integrally mounted on the ball 44 of the arm 36, has moved upwardly into a more horizontal angle in FIG. 8. Hence, the pin or lug 76 has been forced farther upwardly to cause the follower ring 74 to assume the position pictured in FIG. 8.

Figure 4:
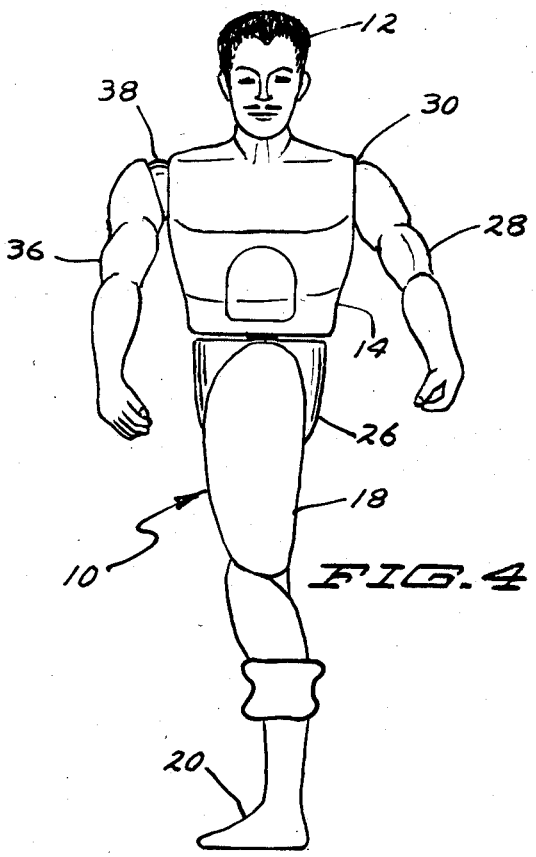
FIG. 4 is a still further advanced view with the actuated arm even closer to the right side of the figure and with the legs having been rotated 270°.
Figure 9:
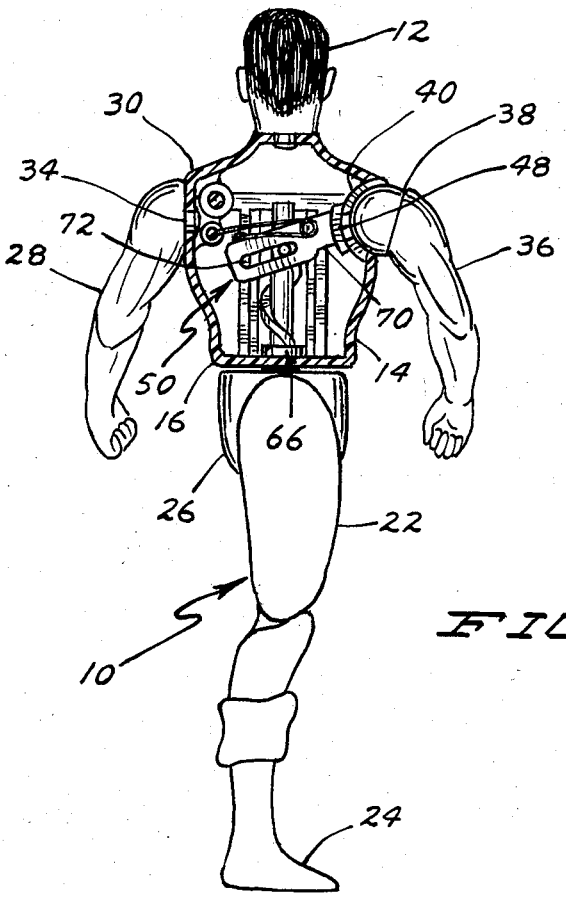
FIG. 9 is another view from the rear but with the legs in the position that they appear in FIG. 4.

If the child continues to press the right arm 36 toward the right side of the action FIG. 10, then the lower torso portion 26 rotates through still another 90° so that the feet 20 and 24 face to the right, as indicated in FIGS. 4 and 9. From FIG. 9, it will be observed that the pin or lug 76 on the follower ring 74 has been forced to still a more elevated position.

Figure 5:
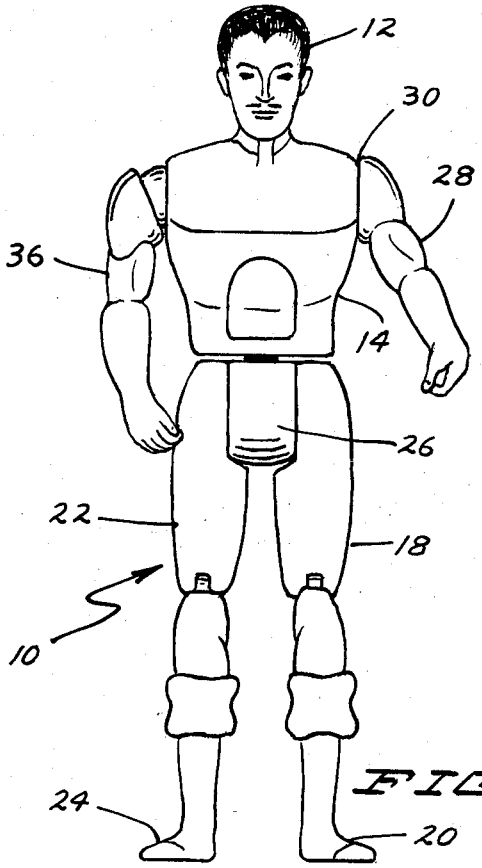
FIG. 5 is a view after the right arm has been fully actuated so that it resides quite close to the right side of the figure and with the legs having been rotated through 360° or a complete circle so that the feet are once again facing forwardly.

When the right arm 36 is pressed quite close to the right side of the FIG. 10, as can be appreciated from FIGS. 5 and 10, then the feet 20 and 24 have been rotated through a complete circle or 360°. From FIG. 10, it will be perceived that the pin or lug 76 has been cammed upwardly so that the follower ring 74 has reached the upper end of its travel, this position of the follower ring 74 also appearing in FIG. 12. Although the spiral flight 68 extends through 360°, it will be recognized that it can embrace more than a complete circle. However, only a complete circle or 360° rotation of the legs 18, 22 about a vertical axis is desired, all as provided by the 360° rotation of the shaft 52.

Figure 2:
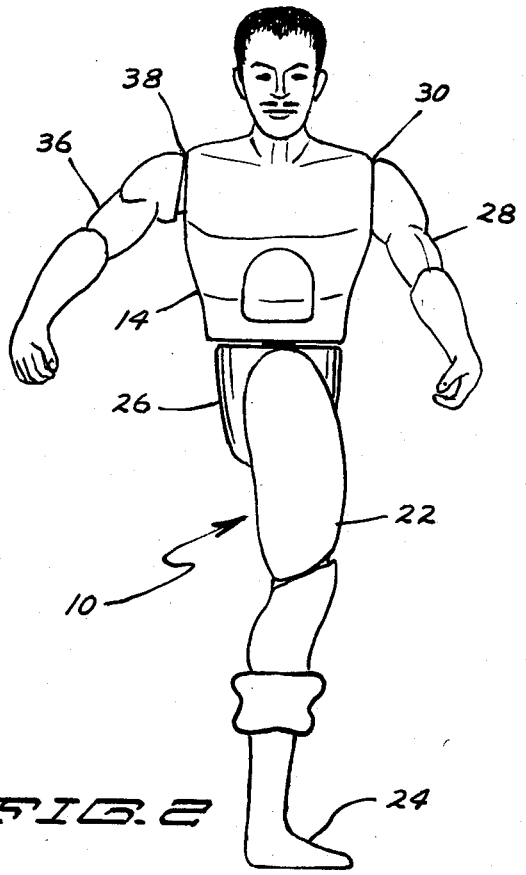
FIG. 2 is a partially actuated view, the right arm having been pressed more toward the right side of the figure and the legs having been rotated through 90°.
Figure 6:
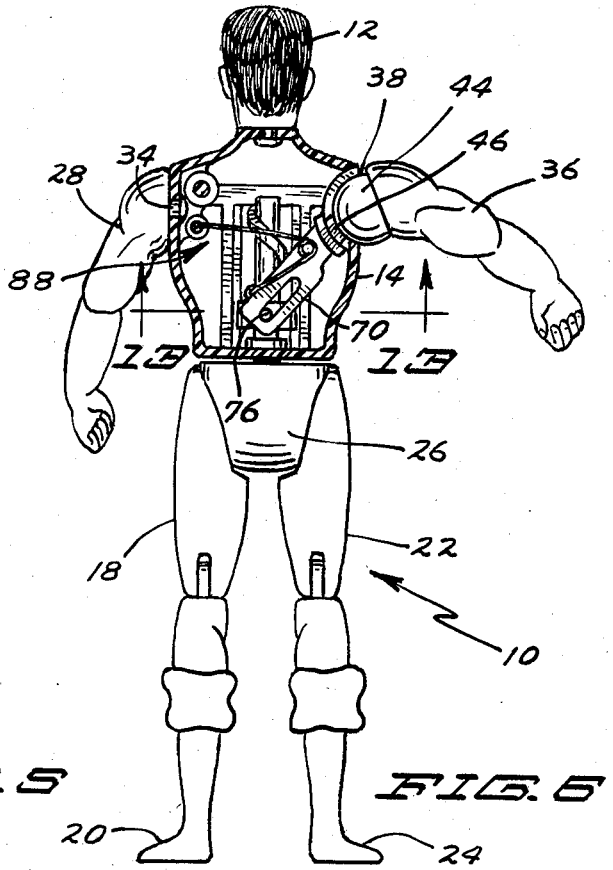
FIG. 6 is a rear view corresponding to FIG. 1 with the back portion of the upper torso portion removed so as to expose to view the actuating mechanism in its unactuated condition.
Figure 7:
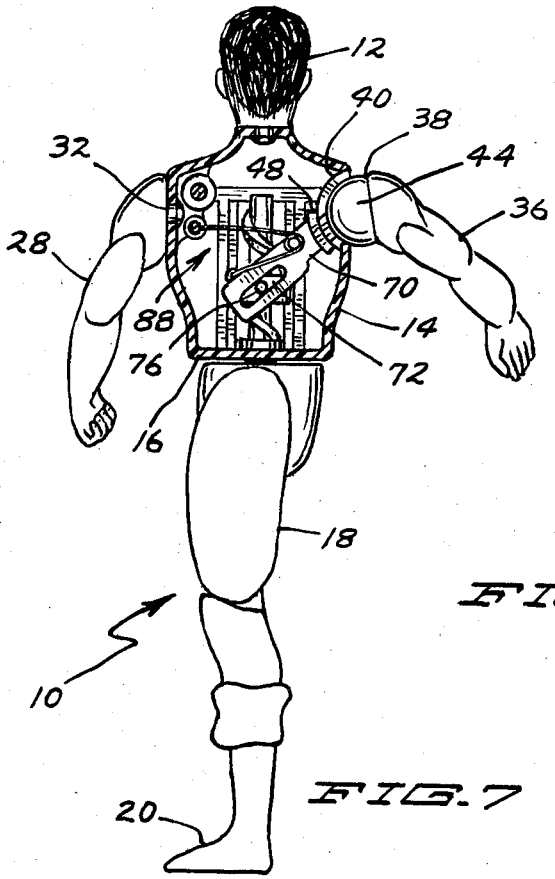
FIG. 7 is a view taken from the rear like FIG. 6 but corresponding to the degree of actuation shown in FIG. 2.

As the actuation of the legs 18, 22 progress from their initial or unactuated position in FIGS. 1 and 6 to their completely actuated position as shown in FIGS. 5 and 10, the hairpin spring 88 is acted upon so that sufficient energy is stored which later causes the entire actuating mechanism 50 to return to its initial or unactuated position. In other words, the follower ring 74, which has been forced from the lowermost position shown in FIGS. 6 and 11, to the uppermost position as illustrated in FIGS. 10 and 12, causes the spring leg 92 to be flexed relative to the spring leg 96. This stored spring energy is released when the child relaxes his or her manipulative pressing of the right arm 36 toward the torso 14. Consequently, after the right arm 36 has reached the position appearing in FIGS. 5, 10, and 12, when the child releases his or her pressure, then the spring 88 causes the follower ring 74 to move downwardly from the elevated position of FIGS. 10 and 12 back to its lowermost position of FIGS. 6 and 11. Not only are the legs 18 and 22 returned to their initial or unactuated position, but the right arm 36 is returned to its unactuated position, so that the arm 36 once again extends at an angle away from the right side of the FIG. 10.

In the event that the child exerts too much torque or twisting force on the lower torso portion 26 relative to the upper torso portion 14, the coil 106 is flexed out of the groove 110. There is an automatic return of the coil 106 into the groove 110 each 180° of relative rotation, so there is an automatic recoupling or reclutching of the lower torso portion 26 with the actuating mechanism 50, more specifically with the shaft 52 via the slotted flange 60 of the lower end thereof, for each 180° of unwanted relative rotation between the torso portions 14, 26.

We claim:

1. A toy action figure comprising a hollow torso portion, a pair of legs, means mounting said legs for rotation about a generally vertical axis relative to said torso portion, a pair of arms, means mounting one of said arms for pivotal movement in a lateral direction relative to said torso portion, means interconnecting said one arm to said leg mounting means for causing rotation of said legs in one rotative direction about said axis when said one arm is manually pivoted in a lateral direction toward said torso, and spring means for biasing said one arm away from said torso portion.

2. A toy action figure in accordance with claim 1 in which said spring means also biases said leg mounting means in a rotative direction opposite to said one direction.

3. A toy action figure in accordance with claim 2 in which said spring means returns said one arm to its unactuated position and concomitantly returns said legs to their unactuated positions.

4. A toy action figure in accordance with claim 1 in which said mounting means includes a lower torso portion and said interconnecting means includes a cam lever on said one arm having a slot therein, a vertical shaft extending upwardly from said lower torso portion into the upper torso portion, a helical gear constituting the upper portion of said shaft, a ring follower encircling said helical gear having a pin or lug in engagement with said helical gear and having a pin or lug engaged in said slot.

5. A toy action figure in accordance with claim 4 including means for constraining said ring follower so that it traverses a rectilinear path relative to said helical gear when moved by said cam lever and by said outwardly projecting pin.

6. A toy action figure in accordance with claim 5 in which said constraining means includes a pair of laterally spaced ribs integral with said torso, said follower ring having side edges slidably received between said ribs.

7. A toy action figure in accordance with claim 5 in which said constraining means includes a groove formed in said torso, said ring follower having a tongue slidably received in said groove.

8. The toy action figure in accordance with claim 4 in which the lower end of said shaft has a groove extending thereacross, and a spring anchored in said lower torso portion having a segment received in said groove so as to release said lower torso relative to said interconnecting means when said torso portions are subjected to a sufficient twising overload.

9. The toy action figure in accordance with claim 8 in which said spring has a coil, a segment of said coil being recived in said groove.

10. The toy action figure in accordance with claim 9 in which said spring also has laterally spaced circular portions confronting opposite sidewalls of said lower torso portion.

11. A toy action figure comprising an upper torso portion and a lower torso portion, a pair of legs mounted to said lower torso portion, means mounting said lower torso portion for rotative movement about a longitudinal axis extending upwardly through said upper torso portion, an actuating mechanism for causing rotative movement of said lower torso portion about said longitudinal axis, an arm mounted to said upper torso portion for angular movement toward and away from said upper torso portion, said arm being connected to said actuating mechanism for causing rotative movement of said lower torso portion with respect to said upper torso portion, said actuating mechanism including a cam lever having a slot therein, a helical gear coupled to said lower torso portion, and a follower constrained for rectilinear movement along said helical gear having a first lug engaged in said slot and having a said second lug engaged with said helical gear.

12. A toy action figure in accordance with claim 11 including a spring whereby said arm is returned to its unactuated position.

13. A toy action figure in accordance with claim 12 in which said spring is hairpin-shaped having one leg engaged with said cam lever and a second leg reactively engaged with a portion of said upper torso portion.

14. A toy action figure in accordance with claim 11 in which said helical gear has a shaft with a groove extending across its lower end, and a spring having a coil projecting upwardly into said groove, said spring being anchored in said lower torso portion, so that said coil is forced out of said groove when an excessive amountof twisting of said lower torso portion relative to said upper torso portion occurs.

15. A toy action figure comprising upper and lower hollow torso portions, a shaft journaled for rotation relative to said upper torso portion, said shaft having a first portion extending upwardly into said upper torso portion and a second portion extending downwardly beneath said upper torso portion into said lower torso portion, a spiral flight on the upper portion of said shaft, said spiral flight having at least a 360° encirclement of said upper shaft portion, means constrained for rectilinear movement along said upper shaft portion having a lug acting against said flight, said constrained means being movable through a distance sufficient to produce a 360° rotation of said shaft, and a pair of legs connected to the lower torso portion so that a 360° rotation of said shaft produces a 360° rotation of said legs.

16. A toy action figure in accordance with claim 15 including an arm mounted for manual movement relative to said upper torso portion, and means movable with said arm for producing said relative movement of said constrained means along said upper shaft portion.

17. A toy action figure in accordance with claim 16 in which said means movable with said arm includes a lever having a slot therein and a second lug received in said slot, said second lug being mounted on said constrained means.

18. The toy action figure in accordance with claim 17 including spring means for releasably connecting said lower torso portion to said shaft.

19. A toy action figure comprising a hollow torso portion, a pair of legs, means mounting said legs for rotation about a generally vertical axis relative to said torso portion, helical means mounted for rotation about said vertical axis and connected to said leg mounting means, a pair of arms, means mounting one of said arms for pivotal movement in a lateral direction relative to said torso portion, and means connected to said one arm and engaging said helical means for causing rotation of said helical means and rotation of said legs in one rotative direction about said axis when said one arm is pivoted in a lateral direction relative to said torso.

* * * * *